US006877442B2

(12) United States Patent
Helle

(10) Patent No.: US 6,877,442 B2
(45) Date of Patent: Apr. 12, 2005

(54) FREE-STANDING TABLE DEVICE

(76) Inventor: Ådne Helle, Vaisenhusgata 41, Stavanger (NO), N-4012

( * ) Notice: Subject to any disclaimer, the term of this patent is extended or adjusted under 35 U.S.C. 154(b) by 66 days.

(21) Appl. No.: 10/312,526

(22) PCT Filed: Jun. 25, 2001

(86) PCT No.: PCT/NO01/00269

§ 371 (c)(1),
(2), (4) Date: Feb. 20, 2003

(87) PCT Pub. No.: WO02/05683

PCT Pub. Date: Jan. 24, 2002

(65) Prior Publication Data

US 2003/0164120 A1 Sep. 4, 2003

(30) Foreign Application Priority Data

Jun. 27, 2000 (NO) ..... 20003338

(51) Int. Cl.[7] ..... A47B 9/00

(52) U.S. Cl. ..... 108/147; 108/189; 108/94; 108/103

(58) Field of Search ..... 108/147, 189, 108/92, 93, 94, 95, 103, 108, 49, 141, 139, 147.19; 248/910, 186.2, 188.5, 183.1, 183.2; 297/241; 280/87.05, 47.17, 47.18

(56) References Cited

U.S. PATENT DOCUMENTS

| | | | | | |
|---|---|---|---|---|---|
| 586,408 | A | * | 7/1897 | Williams | 254/7 R |
| 2,552,592 | A | * | 5/1951 | Rush | 297/195.11 |
| 2,679,890 | A | * | 6/1954 | Zannoth | 248/124.2 |
| 3,908,565 | A | * | 9/1975 | Burnett | 108/147 |
| 4,158,997 | A | | 6/1979 | de Polo | |
| 4,300,809 | A | * | 11/1981 | Brownlee | 312/305 |
| 4,400,032 | A | * | 8/1983 | dePolo | 297/344.24 |
| 4,673,155 | A | * | 6/1987 | Binder | 248/404 |
| 4,790,440 | A | * | 12/1988 | Leszczak | 211/11 |
| 4,976,450 | A | * | 12/1990 | Ellefson | 280/79.11 |
| 5,473,997 | A | * | 12/1995 | Solomon et al. | 108/93 |
| 6,543,369 | B1 | * | 4/2003 | Swensson et al. | 108/49 |

FOREIGN PATENT DOCUMENTS

| | | |
|---|---|---|
| EP | 1005809 | 6/2000 |
| WO | 99/09859 | 3/1999 |

* cited by examiner

*Primary Examiner*—Janet M. Wilkens
(74) *Attorney, Agent, or Firm*—Andrus, Sceales, Starke & Sawall, LLP

(57) ABSTRACT

Free-standing table device wherein the table top (1) arranged in the horizontal plane, is double-hingedly connected to a frame (4) which is arranged to stand, possibly on wheels (5), on an underlying base.

4 Claims, 3 Drawing Sheets

FREE-STANDING TABLE DEVICE

CROSS REFERENCE TO RELATED APPLICATION

Figure 1:
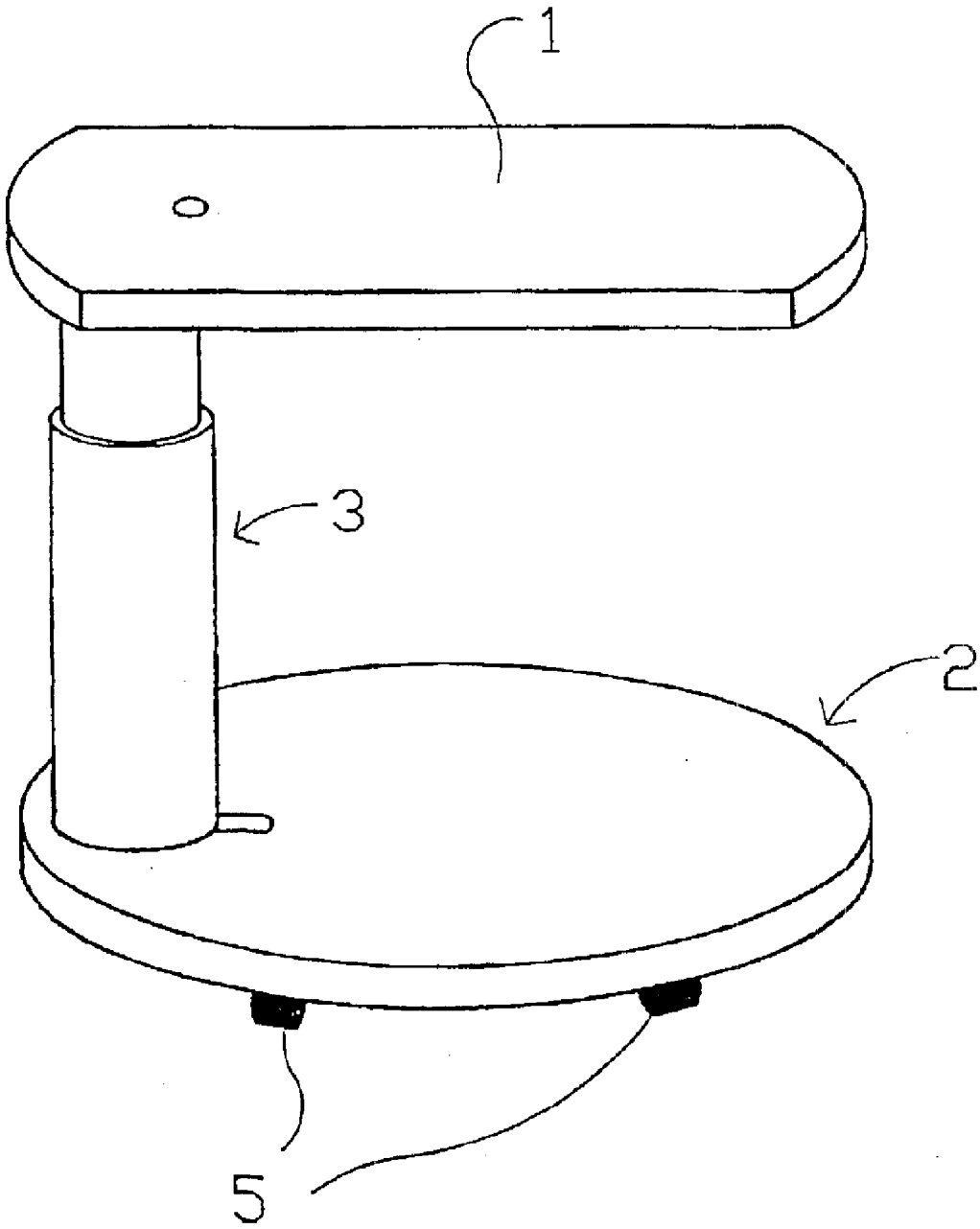

The present application is the U.S. national stage application of International Application PCT/NO01/0000269, filed Jun. 25, 2001, which international application was published on Jan. 24, 2002 as International Publication WO 02/05683, The International Application claims priority of Norwegian Patent Application 20003338, filed June 27, 2000.

SUMMARY OF THE INVENTION

This invention concerns a table revolvably arranged about two or more vertical axes.

Revolving tables, the purpose of which is to move the table top between several different positions relative to the table base, are not known in the art. Wall mounted and double-hinged shelves, particularly those employed as holders for computer monitors and television sets, are, however, known in the art. Within a relevant area of application, e.g. the use of computer equipment, wheeled tables and wheeled racks are used besides stationary tables. One disadvantage of wheeled tables consists in the table top not being easily swung out and over, for example, an armchair, this being due to the base frame of the table colliding with the base of the chair.

BRIEF DESCRIPTION OF THE INVENTION

The objective of the invention is to remedy the negative sides of prior art.

In accordance with the invention, the objective is achieved by means of the features disclosed in the following description and in the subsequent patent claims.

A table top is connected to a base via a telescopic and revolvable foot. The base is revolvably attached to an underlying frame/wheel frame which may be provided with castors of the type used in, for example, office chairs. The foot is attached to the table top proximate one table top edge, and eccentrically to the base relative to the pivot axis of the base. Relative to the anchoring point of the foot, a balance weight is placed on the diametrically opposite side of the base.

The table design comprising a possible wheel-independent revolvable base, a foot-positioning proximate to the edge of the base and the table top, and also comprising a revolveable foot, allows for easy and substantially liberal swinging of the table top between any position within its reach, whether being centred over the base or extending out and over, for example, an armchair. An air spring as known per se being mounted between the table top and the base, is arranged to lock the telescopic function of the foot and to balance out any table load during the lifting and lowering of the table top.

The main parts of the table comprising a table top, a foot and a base, may be provided with openings for the feed-through of, for example, an electrical equipment cable. A locking device which limits the rotation angle of the table, prevents a potential cable from twisting. Advantageously, potential table wheels may be provided with brakes, thus rendering the table stable on the floor during movement of the table components.

BRIEF DESCRIPTION OF THE INVENTION

Figure 2:
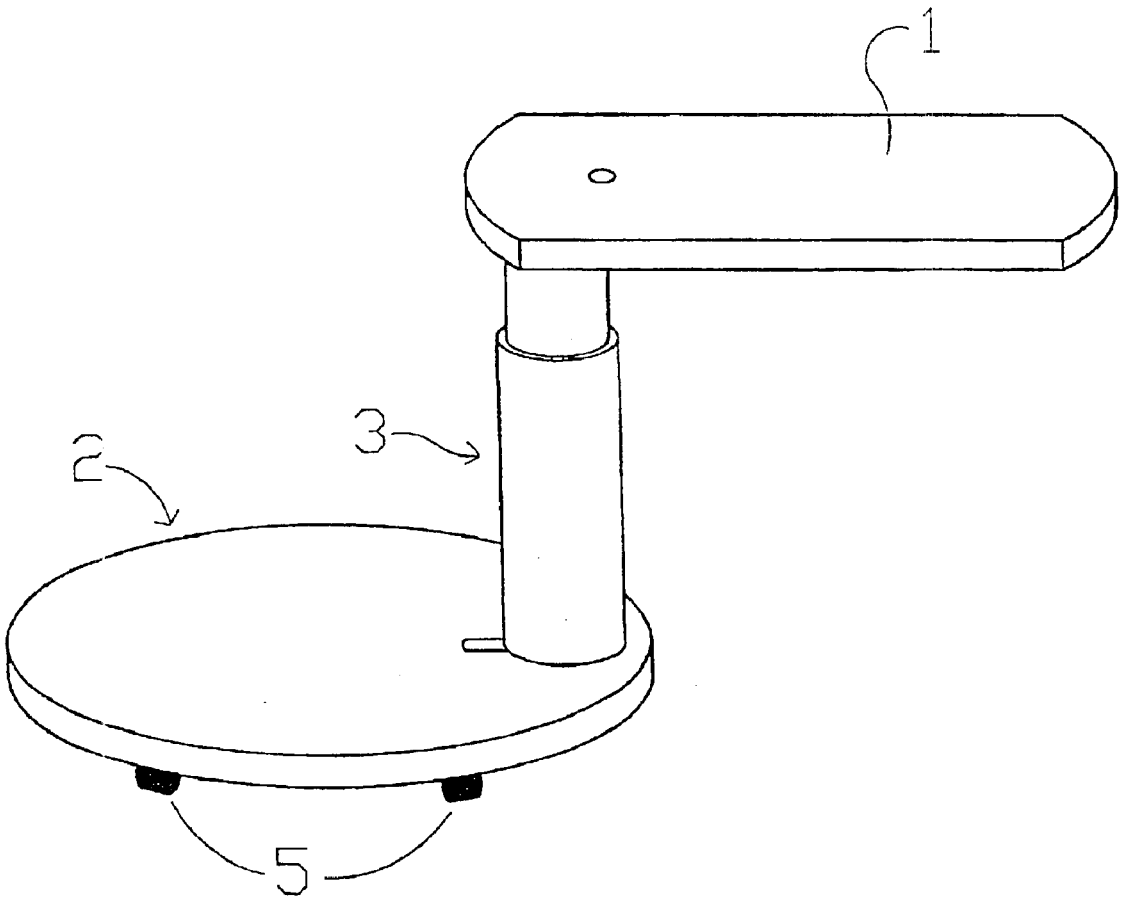

In the following, a non-limiting example of a preferred embodiment of the invention is described, which embodiment is illustrated by the accompanying drawings, wherein:

FIG. 1 displays in perspective the table in a pulled-in position;

FIG. 2 displays in perspective the table in a pulled-out position; and

Figure 3:
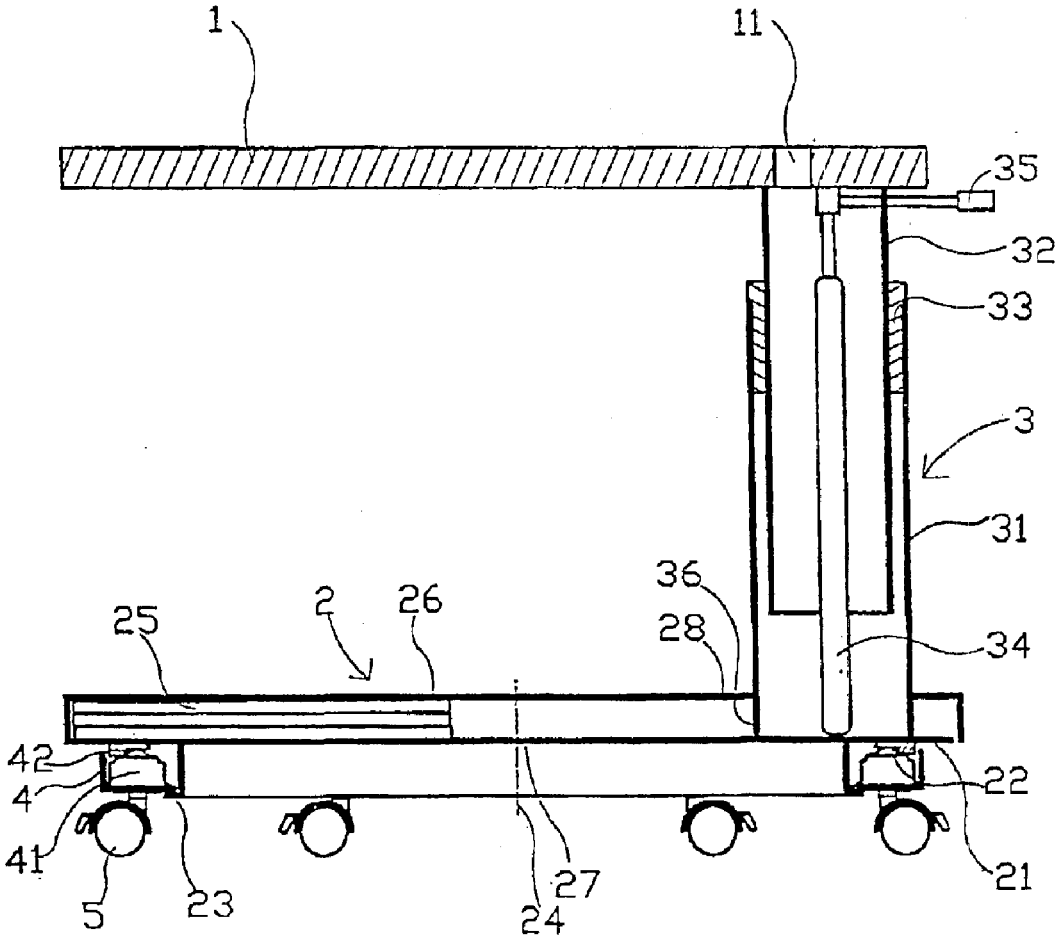

FIG. 3 displays a vertical section through the table.

DETAILED DESCRIPTION OF THE INVENTION

On the drawings, the reference numeral 1 denotes a table top which proximate its one end portion is connected to a base 2 via a telescopic foot 3. In a preferred embodiment, the base 2 is circular, but it may also exhibit a different external geometry. The telescopic foot 3 comprises an outer tube 31, an inner telescopic tube 32, a telescopic bearing 33 and a lever-controlled air spring 34 as known per se. The outer tube 31, which is fixedly connected to the support frame 21 of the base 2, is in its upper end portion fixedly connected to the telescopic bearing 33, while the telescopic tube 32, which is fixedly connected to the table top 1, is movably arranged within the telescopic bearing 33. The air spring is concentrically placed relative to the foot 3, and its respective end portions are connected to the table top 1 and the support frame 21. The bottom side of a wheel frame 4 is furnished with brake-provided castors 5 and the top side with ball housings 41, both as known per se. The balls 42 of the ball housings 41 are placed in a circular groove 22 of the support frame 21 and form, together with the support frame 21, a slew ring bearing. A flange-resembling ring 23 attached to the bottom side of the support frame 21 extends downward and partially underneath the wheel frame 4 and is arranged to prevent the groove 22 of the support frame 21 from being lifted up from the balls 42 during, for example, table transport. On the diametrically opposite side of the foot 3, relative to the centre of rotation 24 of the base 2, a plate-like balance weight 25 is placed within the base 2. In this context, the balance weight 25 may consist of many components, and the mass is adapted to a predetermined maximum weight that the table top 1 can be loaded with while in the pulled-out position, see FIG. 2. Also, aesthetic considerations dictate that the base 2 be provided with a cover plate 26 concealing the balance weight 25 and the support frame 21. Furthermore, the base has dimensions greater than the wheel frame so that the base covers the wheel frame in all rotary positions of the base. A non-displayed cable may be fed from the bottom side of the base 2 to its top side through two openings 27, 28, and to the top side of the table top 1 through an opening 36, the void of the telescopic tube 32 and an opening 11.

The table is wheeled into the desired position on the castors 5. When regulating the height of the table top 1, a lever 35 is operated which, in a conventional manner, releases the air spring 34, such that the telescopic tube 32 may be moved within the telescopic bearing 33. The table top 1 can revolve about the centre axis of the foot 3 and about the axis 24 of the base 2, thus being arranged to assume within its reach, any position in the horizontal plane. Upon applying loads within allowable limits, the balance weight 25 prevents the table from tilting while being in a pulled-out position, see FIG. 2.

What is claimed is:

1. A free-standing table device comprising:

a horizontal wheel frame (4) supported on wheels (5);

a horizontal base (2) including a support frame (21), the support frame (21) being coupled to said wheel frame to allow said base (2) to rotate in a horizontal plane with respect to said wheel frame, said base (2) having dimensions greater than the corresponding dimensions of said wheel frame so that said base covers said wheel frame (4) in all rotary positions of said base;

a vertically extending table foot (3) connected to said base (2) proximate an edge of said base, said table foot defining a vertical axis in said table device; and a horizontal table (1) connected to said table foot proximate to an edge of said table, the table being rotatable about said vertical axis to move said table to a desired position with respect to said base.

2. A free-standing table according to claim 1 further including a fixed weight (25) mounted on said base (2) at a portion of said base opposite the edge proximate to which said table foot (3) is connected.

3. A free-standing table according to claim 2 wherein said base (2) and balance weight (25) are covered with a cover plate.

4. A free-standing table according to claim 1 wherein said base and table foot include means for feeding an electrical equipment cable to said table.

* * * * *